US005573236A

United States Patent [19]

Petocchi et al.

[11] Patent Number: 5,573,236

[45] Date of Patent: Nov. 12, 1996

[54] VARIABLE SHEET GUIDE POSITION SENSOR

[75] Inventors: Ermanno C. Petocchi; Norman D. Robinson, Jr., both of Rochester; Thomas Acquaviva, Penfield; David E. Damouth, Rochester, all of N.Y.

[73] Assignee: Xerox Corporation, Stamford, Conn.

[21] Appl. No.: 286,352

[22] Filed: Aug. 5, 1994

[51] Int. Cl.[6] ..... B65H 7/02

[52] U.S. Cl. ..... 271/265.02; 271/171; 250/559.19; 250/214 PR

[58] Field of Search ..... 250/214 PR, 559.19, 250/559.24, 559.26; 271/171, 265.01, 265.02, 145, 9.06; 355/311

[56] References Cited

U.S. PATENT DOCUMENTS

| | | | |
|---|---|---|---|
| 4,103,155 | 7/1978 | Clark | 250/214 PR |
| 4,190,246 | 2/1980 | Sasuga | 271/145 |
| 4,780,740 | 10/1988 | Fukae | 355/3 |
| 4,786,042 | 11/1988 | Stemmle | 271/9 |
| 4,859,845 | 8/1989 | Sakano | 250/214 PR |
| 5,036,354 | 7/1991 | Miyamoto | 355/75 |
| 5,053,814 | 10/1991 | Takano et al. | 271/265.01 |
| 5,110,106 | 5/1992 | Matsumura et al. | 271/9 |
| 5,130,757 | 7/1992 | Ito | 355/311 |
| 5,172,178 | 12/1992 | Oushiden et al. | 355/311 |
| 5,188,351 | 2/1993 | Gysling | 271/171 |
| 5,251,889 | 10/1993 | Spencer et al. | 271/171 |
| 5,329,114 | 7/1994 | Fields | 250/214 PR |
| 5,360,207 | 11/1994 | Rauen et al. | 271/171 |

FOREIGN PATENT DOCUMENTS

| | | | |
|---|---|---|---|
| 60-026546 | 9/1985 | Japan . | |
| 0100930 | 4/1990 | Japan | 271/171 |
| 405043058 | 2/1993 | Japan | 271/171 |
| 405043060 | 2/1993 | Japan | 271/171 |
| 405254696 | 10/1993 | Japan | 271/145 |

OTHER PUBLICATIONS

Xerox Disclosure Journal—Nov./Dec. 1992 vol. 17, Issue 6 Author: Peskor, et al.

Xerox Disclosure Journal, vol. 17, No. 6, pp. 467–468 By: S. Peskor and J. Fantuzzo.

*Primary Examiner*—H. Grant Skaggs
*Attorney, Agent, or Firm*—Kevin R. Kepner

[57] ABSTRACT

An apparatus for determining the dimensions of a stack of sheets in the tray. An optical sensor is arranged so that movement of the sheet guides in a paper tray causes a variably graduated scale to be moved past the sensor. The sensor may either be a transmissive or reflective type analog sensor in which the strength of the signal generated by the sensor is converted into a position of the side guides and as the analog scale is continuously variable, there is no need for separate discrete sensors or switches and sheet sizes of any dimension can be accommodated. A recalibration process is used to prevent contamination of the gauge and the associated change in signal strength by this sensor from causing the size determinations to be inaccurate. Alternatively, a digital sensor in cooperation with a digital bar code or other digital scale can be utilized to determine the variable sheet size, which digital sensor and variable scale are insensitive to contamination by dirt or paper particles, etc. The sensor system herein is very robust and provides a simple device for determining the size of a stack of sheets in a paper tray.

4 Claims, 6 Drawing Sheets

VARIABLE SHEET GUIDE POSITION SENSOR

This invention relates generally to a sheet size sensor for a printing machine, and more particularly concerns a continuously variable sheet size sensor for an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In many of the machines described above, sheets are fed into the machine from a holding tray. Many of these trays have various schemes to sense and indicate the size of the sheets available in the tray. Usually, the guides for the paper stack are visually observed by an operator to determine the size of the copy sheets in a tray. More sophisticated systems utilize a switch or series of switches in combination with a lookup matrix to determine the sheet size based on the condition of each switch or switches. To accurately determine a sheet size with this method a sizable number of switches are required and the number of sheet sizes sensed is limited to a relatively small number of standard sized sheets.

It would be desirable to have a sheet size sensor which can sense any sheet dimension within a holding tray based of guide position and generate a signal indicative thereof. It would be further advantageous to have a sensor which is relatively inexpensive and does not require a multitude of discrete switches.

The following disclosures may be relevant to various aspects of the present invention:

- U.S. Pat. No. 5,188,351 Inventor: Gysling Issue Date: Feb. 23, 1993
- U.S. Pat. No. 5,172,178 Inventor: Oushiden, et al Issue Date: Dec. 15, 1992
- U.S. Pat. No. 5,130,757 Inventor: Ito Issue Date: Jul. 14, 1992
- U.S. Pat. No. 5,110,106 Inventor: Matsumura, et al Issue Date: May 5, 1992
- U.S. Pat. No. 5,036,354 Inventor: Miyamoto Issue Date: Jul. 30, 1991
- U.S. Pat. No. 4,786,042 Inventor: Stemmle Issue Date: Nov. 22, 1988
- U.S. Pat. No. 4,780,740 Inventor: Fukae Issue Date: Oct. 25, 1988
- U.S. Pat. No. 4,190,246 Inventor: Sasuga Issue Date: Feb. 26, 1980
- Xerox Disclosure Journal, Vol. 17, Issue 6 Author: Peskor et al. Published: November/December 1992

The relevant portions of the foregoing disclosures may be briefly summarized as follows:

U.S. Pat. No. 5,188,351 discloses a multi-size paper cassette for a printer having a housing which is adapted to receive a back wall and paper receiving shelf and slidable engagement with the housing side walls during paper size adjustment and loading of paper into the cassette. The cassette includes a mechanical shaft member attached to a side wall of the paper cassette and a mechanical shaft member connected to an end wall of the paper cassette. The mechanical attachments, when placed in contact with the edges of the paper stack cause a corresponding visual indicator on the cassette front wall to be positioned at a discrete paper size indicator.

U.S. Pat. No. 5,130,757 discloses a printing machine having a sheet holding tray which includes a plurality of fixed switches, which switches determine the sheet size in the paper tray based on a lookup table corresponding to several standard sizes of sheets.

U.S. Pat. No. 5,110,106 describes a printing machine having a plurality of sheet storing containers in which detectors in the form of fixed switches determine the positions of the sheet guides and accordingly the corresponding sheet size in each container.

U.S. Pat. No. 4,786,042 describes an adjustable sheet cassette for use in an apparatus feeding sheets such as a copier or printing machine in which sheet width and length dimension representing members are independently movable to a plurality of positions representing a plurality of sheet width and length dimensions. The movable width and dimension representing members contact switches in the main printing machine to indicate the size of the sheets within the tray.

U.S. Pat. No. 4,780,740 describes a paper cassette for storing and supplying paper to a printer or copier, which includes movable longitudinal or horizontal paper guides within the cassette. The position of the guides are determined by a series of switches located within the cassette which then give an indication of the paper size in the tray.

U.S. Pat. No. 4,190,246 describes a selector circuit for use with a paper tray in a copy machine to determine the sizes of paper stored in the paper trays. The size of the sheet in the tray is determined by discrete switches or sensors located in the tray and the overall dimension of the sheet is determined based on a lookup table having a matrix corresponding to different switch positions.

Xerox Disclosure Journal, Vol. 17, Issue 6 discloses a variable size determining sheet guide for a paper tray utilizing a SoftPot™ or infinitely variable membrane potentiometer linked to a paper guide. The varying resistance values for different guide positions corresponds to varying sheet sizes.

In accordance with one aspect of the present invention, there is provided an apparatus for detecting the size of the sheet. The apparatus comprises an optical sensor and a variable scale operatively associated with said optical sensor so that different sized sheets are positioned at different positions on said variable scale, wherein said sensor generates a signal uniquely indicative of the position of the sheet relative to said variable scale to provide an indication of the sheet size.

Pursuant to another aspect of the present invention, there is provided an electrophotographic printing machine having a device for detecting the size of a sheet. The device comprises an optical sensor and a variable scale operatively associated with said optical sensor so that different sized sheets are positioned at different positions on said variable scale, wherein said sensor generates a signal uniquely indicative of the position of the sheet relative to said variable scale to provide an indication of the sheet size.

Pursuant to yet another aspect of the present invention, there is provided a method for calibrating an analog positional sensor for a sheet guide. The method comprises the steps of determining the signal strength of the sensor at a first end of travel position of the guide, determining the signal strength of the sensor at a second end of travel position, opposed from said first end of travel position of the guide and determining the position of the guide for all locations between said first end of travel position and said second end of travel position as a function of signal strength.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 6:
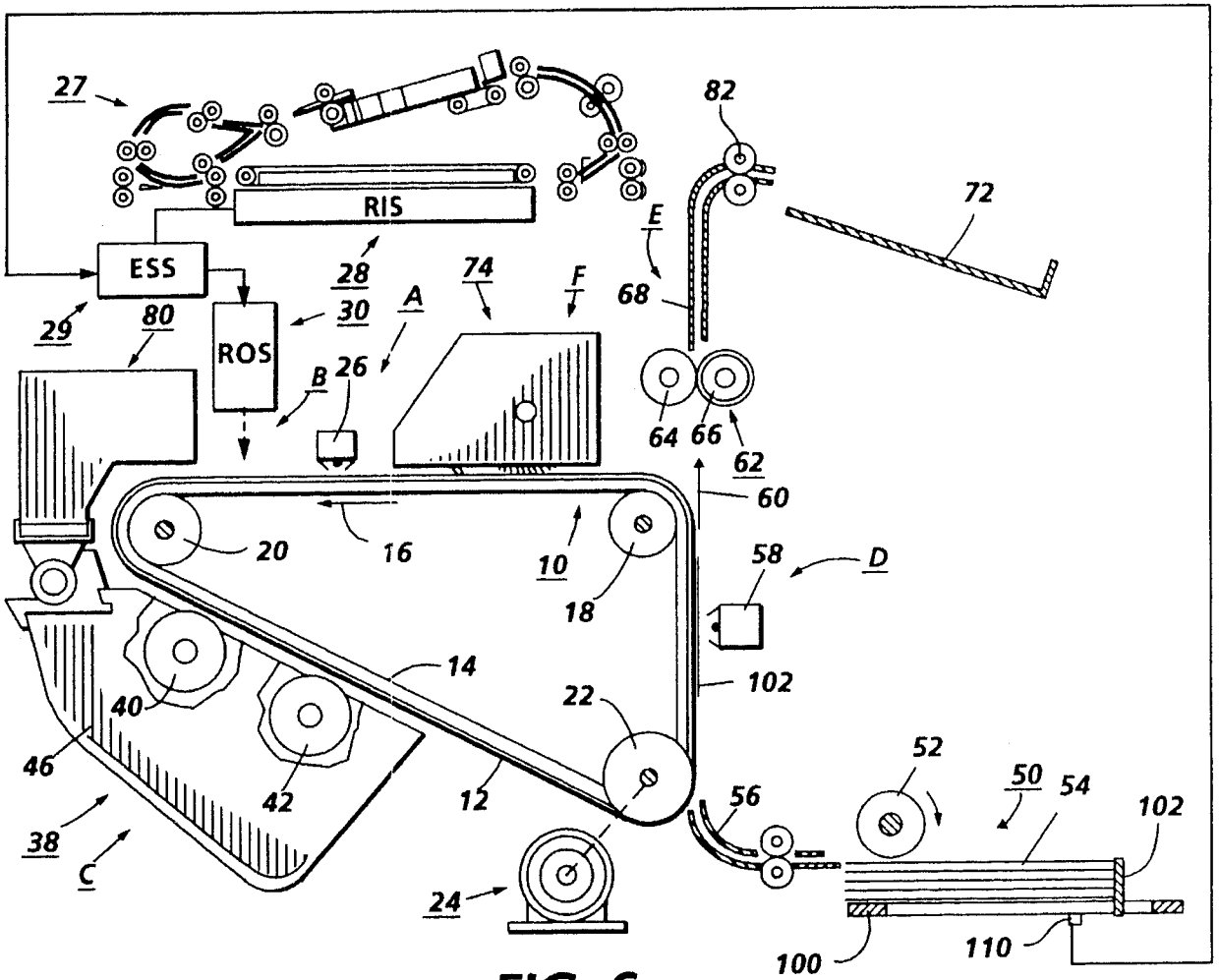
FIG. 6 is a schematic elevational view of an electrophotographic printing machine incorporating the FIG. 1 tray therein.

For a general understanding of the features of the present invention, reference is made to the drawings. In the drawings, like reference numerals have been used throughout to identify identical elements. FIG. 6 schematically depicts an electrophotographic printing machine incorporating the features of the present invention therein. It will become evident from the following discussion that the sheet size sensor of the present invention may be employed in a wide variety of devices and is not specifically limited in its application to the particular embodiment depicted herein.

Referring to FIG. 6 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

The FIG. 6 printing machine employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers.

The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 20 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 20 on a raster-by-raster basis.

After the electrostatic latent image has been recorded on photoconductive surface 12, belt 10 advances the latent image to a development station C, where toner, in the form of liquid or dry particles, is electrostatically attracted to the latent image using commonly known techniques. Development station C contains the space optimizing toner cartridge described in detail below. Preferably, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. The toner particle dispenser, indicated generally by the reference numeral 80, dispenses toner particles into developer housing 46 of developer unit 38.

With continued reference to FIG. 6, after the electrostatic latent image is developed, the toner powder image present on belt 10 advances to transfer station D. A print sheet 48 is advanced to the transfer station, D, by a sheet feeding apparatus, 50, the stacking tray of which includes the sensors of the invention herein. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station, E, includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 again through one or more drive roll idler roll assembly 82 to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes, a rotatably mounted fibrous brush in contact with photoconductive surface 12 to disturb and remove paper fibers and a cleaning blade within the cleaner housing 74, to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 1:
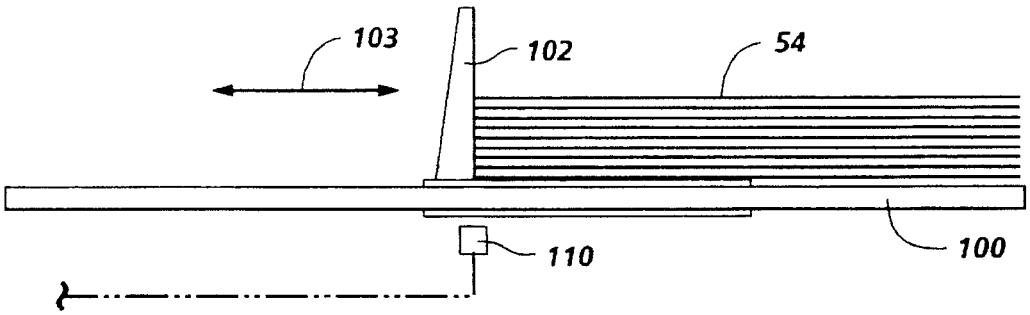
FIG. 1 is an elevational view of a first embodiment of a paper tray using the continuously variable sheet size sensor therein.
Figure 2:
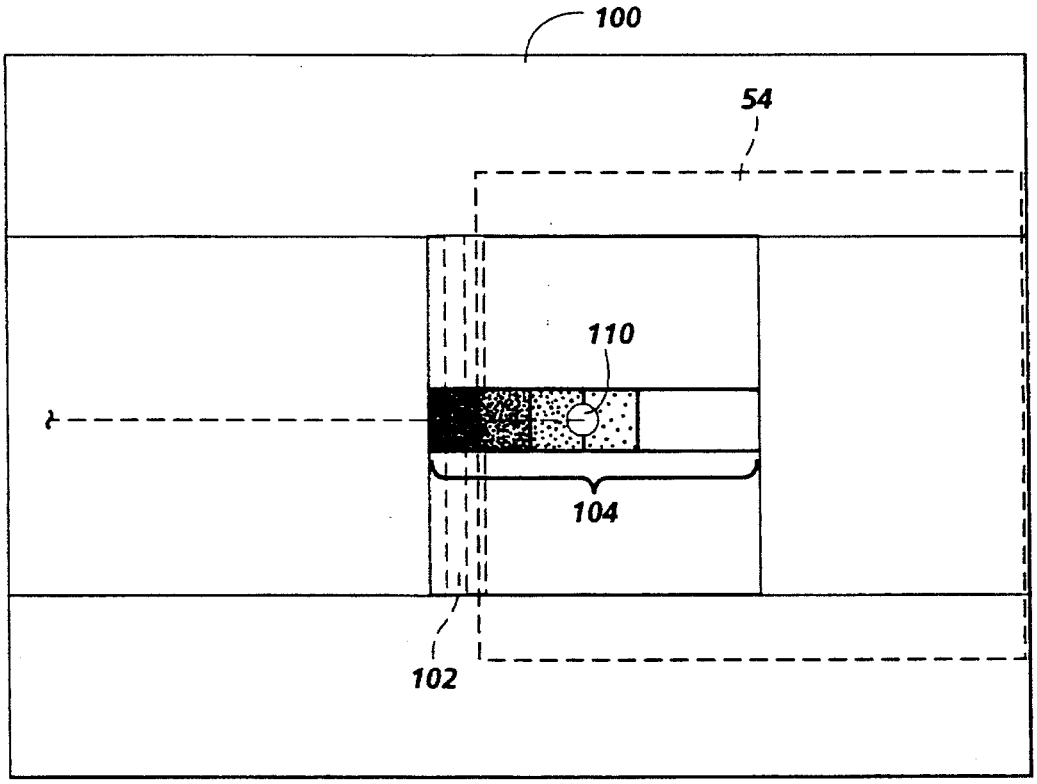
FIG. 2 is a bottom plan view of the FIG. 1 paper tray.

Turning now to FIG. 1, there is illustrated an elevational view of a paper tray incorporating the continuously variable size sensor of the present invention. FIG. 1 illustrates the tray base section 100 having a movable paper guide 102 adapted to slide in the direction of arrows 103 so as to be placed against a stack 54 of paper in the tray 100. As illustrated in FIG. 2, the movable guide 102 has a continuously variable greyscale 104 imprinted on the bottom thereof which greyscale is in a position to be sensed by the sensor 110 located under the tray 100. In this illustrated embodiment, the sensor 110 is a reflective type sensor in which a signal is emitted an emitter portion of the sensor, reflected off of the greyscale and then sensed by a receiver portion of the sensor, which sensor 110 then generates a signal as a function of the amount of reflected signal value. A variety of sensors known in the art can be used to sense the greyscale pattern. The pattern is optically readable by illuminating the pattern with a light emitter and sensing the patterns of reflected light. In one embodiment, the sensor is divided into subsections comprising known photoemitter/photosensor pairs. Preferably, the emitter/sensor pair is in close proximity because the reflected light pattern is more precisely detected by such a device. Alternatively, as described below with respect to FIGS. 3 and 4 for a film type scale, the emitter/sensor pair can be separated by the scale. The film scale would then pass between the pair and provide a pattern of transmitted light. By calibrating the sensor signal level to the positions along the greyscale 104 the sensor 110 determines the position of the paper guide 102 wherever it may be along the paper holding base 100. There is no need for a series of discrete switches or a matrix of sensors that must be actuated to determine the size of the paper in the tray. A second guide (not shown) can be utilized in a direction perpendicular to that of the first guide 102 so that the size of the paper stack in the tray can be determined in both the lengthwise and widthwise directions. Likewise a pair of guides can be linked to align the sheet stack in the center of the paper tray for applications in which a center registered sheet path is used.

The signal from the sensor is forwarded to the machine controller which then utilizes the signal in various ways. As an example, the controller can determine, based upon the scanned image size, whether the sheet size in the tray is appropriate for the image to be copied or printed. Should the image size not be compatible with the sensed paper size, a signal can be sent to the operator of the machine to correct same. Alternatively, the controller can automatically make the determination that the scanned image size must be scaled in one direction or another so as to allow it to properly print onto the sheet which is in the paper tray.

Figure 3:
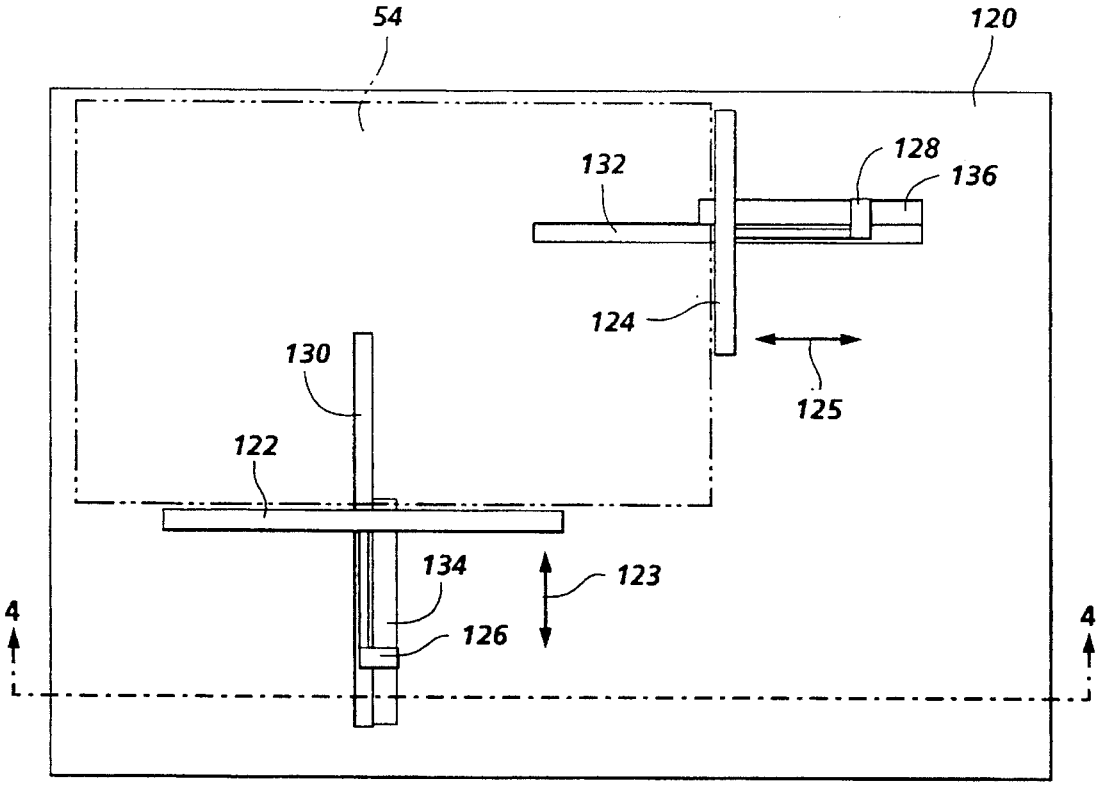
FIG. 3 is a plan view of a second embodiment of the continuously variable sheet size sensor.
Figure 4:
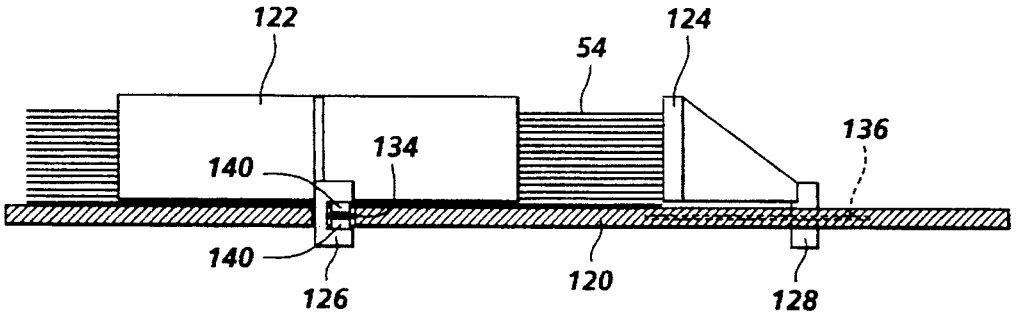
FIG. 4 is a sectional elevational view of the FIG. 3 tray taken along the line in the direction of arrows 4—4.

Turning next to FIGS. 3 and 4, a second embodiment utilizing the continuously variable sensor of the present invention is illustrated. In FIG. 3, there is shown a plan view of the paper holding tray 120 having a paper guide 122 for the length dimension of the stack and a paper guide 124 for the the width dimension of the stack. Attached to each of the paper guides 122, 124 are horseshoe type transmissive sensors 126, 128 which are mounted to slide along openings 130, 132 in the bottom of the paper tray 120 in the direction of arrows 123 and 125. This is more clearly illustrated in FIG. 4, which is a partial cut-away view of FIG. 3 along the line in the direction of arrows 4—4. Continuously variable greyscale films 134, 136 and/or continuously variable color scale films (not shown) are mounted into the bottom of the paper tray 120 adjacent the openings 130, 132 so that the sensor envelops the film. A signal is emitted from the emitter portion of the sensor and the amount of the signal energy which passes through the film 134, 136 and is received by the receptor portion of the sensor 126, 128 is used to determine the position along the slot. Thus the signals from the two sensors 126, 128 are used to determine the length and width dimensions of the paper stack 54. To maintain accurate readings and prevent a degradation of the quality of the signal, a wiper member 140 is built into the sensor so that the scale is constantly wiped free of dirt and/or dust and paper particles so that signal strength remains constant for a given position along the scale.

A recalibration process is performed at regular intervals to assure accurate dimensional readings. The recalibration process consists of moving the sensors from one extreme position along the scale to the opposite extreme position and recording the signal strength therealong. As the two extreme positions are known the intermediate positions can be recalibrated by the controller to maintain positional accuracy based upon the new signal strength readings.

A third embodiment would be to use a similar type sensor, however have a bar code type or other digitally readable scale and use a digital rather an analog sensor. One advantage of the digital sensor is that it is unaffected by dirt particles and/or a contamination of the scale as the digital signal remains constant as long as the sensor can differentiate between the bar code and the background and thus eliminate the need for a recalibration scheme. The digital sensor could be either a reflective or transmissive type sensor.

Figure 5A:
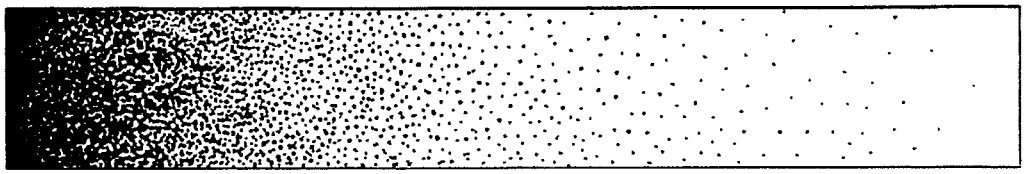
FIGS. 5A through 5E are various representations of different types of sensing scales that are utilized in the invention herein.
Figure 5B:
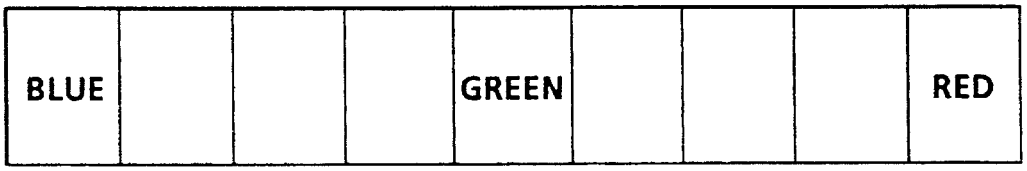
Figure 5C:
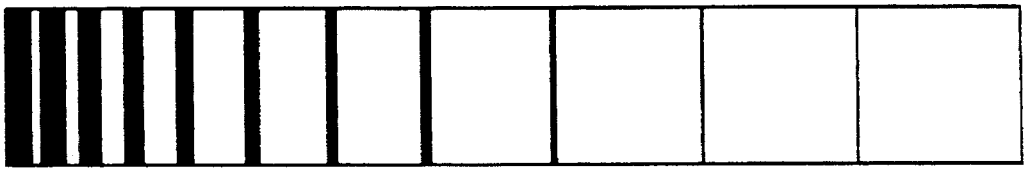
Figure 5D:
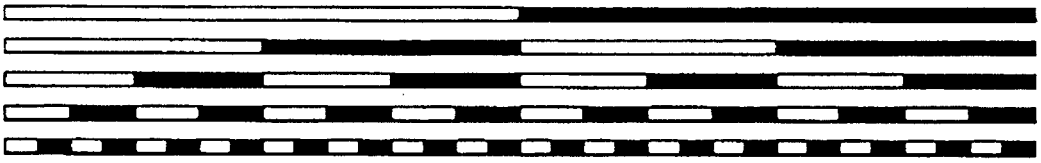
Figure 5E:
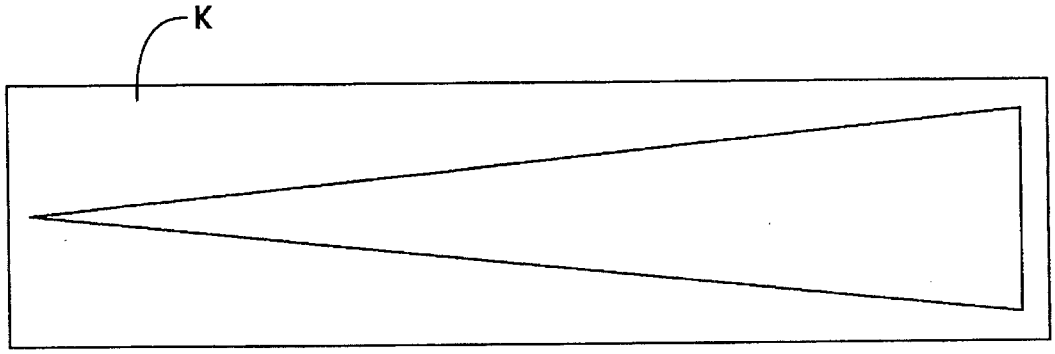

FIGS. 5A, 5B and 5E illustrate three examples of the continuously variable scales that can be utilized. FIG. 5A is a continuously variable greyscale which varies from black to white with many levels of gray between the black and white. The function of the greyscale sensor is described above.

FIG. 5B is a continuous color pattern that varies from end to end. As an example, the strip contains a color pattern which changes from all blue on one end to all green to all red at the other end. It really consists of a dot pattern of blue and red dots (more blue on one end than another) against a black background. An arrangement of red and blue LEDs are used and are multiplexed by the microcomputer 29. When looking at a particular end of the strip, say the blue end, the sensor receives light alternately from both the blue or red LED. When the blue LED is on, it receives a high output because the strip at that point is blue. When the red LED is on, it receives a low output. The amplifier looks at the ratio of the two signals and decides that it is looking at the blue end of the strip. The sensor has a filter over it to ensure uniform sensitivity to both colors. As a result of this arrangement, the sensor detects what part of the strip is being sensed. An analog to digital converter produces a digital signal out indicating to the machine the exact guide setting. A similar arrangement is used for transmissive color detection.

FIG. 5E is a tapered transparent scale surrounded by opaque black. The wide end of the transparent section is the same width as the sensor. As the sensor moves toward the narrow end, progressively less light is transmitted from the emitter to the sensor, giving a continuously variable signal proportional to the position of the sensor and paper guide, just as with the greyscale shown in FIG. 5A. Since no actual grey is required, only black and transparent (or black and white in the case of the reflective mode described earlier), the scale shown in FIG. 5E may be less expensive than that of 5A. It should also be noted that if the transparent region is cut out completely (a tapered slot in an opaque material), then the signal will not be degraded by the dirt which could accumulate on a transparent or reflective material.

FIGS. 5C, 5D and 5E (note that the scale of FIG. 5E can be used with either a digital or continuous sensor) are scales adapted for using binary digital rather than continuously variable analog sensors.

In FIG. 5C, a small scanner or a close spaced linear array of many binary sensors (which is commercially available as a single silicon chip) scans a portion of the scale through a fixed sized window. As an example, the window can be 10 units wide. The pattern is designed to that any 10 unit signal section of the pattern uniquely identifies that position along the pattern. Accordingly, based on the pulse signal generated by the scanner, or the pattern of signals from the array of multiple sensors, the position of the sheet guide is known. The use of this type of sensor has the advantage that it is relatively insensitive to dirt contaminations in that as long as the black and white portions of the pattern can be distinguished, the sensor will function correctly. Again, this sensor may be either a reflective or transmissive sensor.

FIG. 5D is another type of binary scale which requires only a few binary sensors. In the example shown, five sensors are used, each positioned above one of the five stripes. The signal from the five sensors is a five-digit binary number (from 0 to 31) uniquely determining over which of the 32 zones the sensors are positioned, providing a measurement of 32 different paper sizes. It should be understood that this is just an example. If six stripes and six sensors were used, 64 paper sizes could be distinguished. Although the illustration shows all zones the same size, this is not necessary, and smaller zones could be used in regions where more accurate measurement is desired. As with the other scales, the scale of FIG. 5D could be either reflective or transmissive.

FIG. 5E is also well suited to using the scanner or linear array of multiple sensors described above. The black rectangle has a white or grey contrasting triangle superimposed thereon to provide a variable scale. In this case, the scanner or array is positioned to scan across the tapered transparent or reflective region, and the ratio of the number of black scan units or sensors to the number of white or grey scan units or sensors uniquely determines the position of the sensor along the scale.

In recapitulation, there is provided an apparatus for determining the dimensions of a stack of sheets in the tray. An optical sensor is arranged so that movement of the sheet guides in a paper tray causes a continuously variably graduated scale to be moved past the sensor. The sensor may either be a transmissive or reflective type sensor and the strength of the signal generated by the sensor is converted into a position of the side guides as the scale is continuously variable, there is no need for discrete sensors or switches and sheet sizes of any dimension can be accommodated. A recalibration process is used to prevent contamination of the gauge and the associated change in signal strength by this sensor from causing the size determinations to be inaccurate. Alternatively, a digital sensor in cooperation with a digital bar code or other digital pattern can be utilized to determine the variable sheet size, which digital sensor and variable scale are substantially insensitive to contamination by dirt or paper particles, etc. The sensor system herein is very robust and provides a simple device for determining the size of a stack of sheets in a paper tray.

It is, therefore, apparent that there has been provided in accordance with the present invention, a sheet guide position sensor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for detecting the size of a sheet, comprising:

an optical sensor;

a sheet position indicator;

a variable scale operatively associated with said optical sensor so that different sized sheets are positioned at different positions along said variable scale, wherein said sensor generates a signal uniquely indicative of the position of the sheet relative to said variable scale to provide an indication of the sheet size;

a second optical sensor;

a second sheet position indicator; and a second variable scale operatively associated with said second optical sensor so that different sized sheets are positioned at different positions along said second variable scale, wherein said second sensor generates a signal uniquely indicative of the position of the sheet relative to said second variable scale to provide an indication of the sheet size; and a first wiper member operatively associated with said first mentioned optical sensor to prevent contamination of said first mentioned variable scale.

2. An apparatus for detecting the size of a sheet comprising:

an optical sensor; and a variable scale operatively associated with said optical sensor so that different sized sheets are positioned at different positions along said variable scale, wherein said sensor generates a signal uniquely indicative of the position of the sheet relative to said variable scale to provide an indication of the sheet size;

a second optical sensor; and a second variable scale operatively associated with said second optical sensor so that different sized sheets are positioned at different positions along said second variable scale, wherein said second sensor generates a signal uniquely indicative of the position of the sheet relative to said second variable scale to provide an indication of the sheet size; and a second wiper member operatively associated with said second optical sensor to prevent contamination of said second variable scale.

3. An electrophotographic printing machine having a device for detecting the size of a sheet, comprising:

an optical sensor;

a sheet position indicator;

a variable scale operatively associated with said optical sensor so that different sized sheets cause said sheet position indicator to be positioned at different positions along said variable scale, wherein said sensor generates a signal uniquely indicative of the position of the sheet relative to said variable scale to provide an indication of the sheet size;

a second optical sensor;

a second sheet position indicator;

a second variable scale operatively associated with said second optical sensor so that different sized sheets cause said second sheet position indicator to be positioned at different positions along said second variable scale, wherein said second sensor generates a signal uniquely indicative of the position of the sheet relative to said second variable scale to provide an indication of the sheet size; and a first wiper member operatively associated with said first mentioned optical sensor to prevent contamination of said first mentioned variable scale.

4. An electrophotographic printing machine having a device for detecting the size of a sheet, comprising:

an optical sensor;

a variable scale operatively associated with said optical sensor so that different sized sheets are positioned at different positions along said variable scale, wherein said sensor generates a signal uniquely indicative of the position of the sheet relative to said variable scale to provide an indication of the sheet size;

a second optical sensor;

a second variable scale operatively associated with said second optical sensor so that different sized sheets are positioned at different positions along said second variable scale, wherein said second sensor generates a signal uniquely indicative of the position of the sheet relative to said second variable scale to provide an indication of the sheet size; and a second wiper member operatively associated with said second optical sensor to prevent contamination of said second variable scale.

* * * * *